US010046870B2

(12) United States Patent
Ouellette

(10) Patent No.: US 10,046,870 B2
(45) Date of Patent: Aug. 14, 2018

(54) FLEXIBLE BAG

(71) Applicant: GE HEALTHCARE BIO-SCIENCES CORP., Piscataway, NJ (US)

(72) Inventor: Matthew David Ouellette, Westborough, MA (US)

(73) Assignee: GE HEALTHCARE BIO-SCIENCES CORP., Piscataway, NJ (US)

( * ) Notice: Subject to any disclaimer, the term of this patent is extended or adjusted under 35 U.S.C. 154(b) by 615 days.

(21) Appl. No.: 14/258,058

(22) Filed: Apr. 22, 2014

(65) Prior Publication Data

US 2015/0298829 A1 Oct. 22, 2015

(51) Int. Cl.

| | |
|---|---|
| ***B65B 3/04*** | (2006.01) |
| ***B65D 33/00*** | (2006.01) |
| ***B65D 77/06*** | (2006.01) |
| ***B65D 88/16*** | (2006.01) |
| *B65D 33/18* | (2006.01) |
| *B65D 33/24* | (2006.01) |
| *B65D 33/25* | (2006.01) |

(52) U.S. Cl.

CPC ..... *B65B 3/04* (2013.01); *B65D 33/007* (2013.01); *B65D 77/06* (2013.01); *B65D 88/16* (2013.01); *B65D 33/18* (2013.01); *B65D 33/24* (2013.01); *B65D 33/2508* (2013.01); *B65D 2313/02* (2013.01)

(58) Field of Classification Search

CPC .. B65D 33/007; B65D 2313/02; B65D 33/18; B65D 33/24; B65D 33/2508; B65D 33/00; B65D 88/16; B65D 77/06; B65D 25/16; B65D 5/545; B65D 77/065; B65B 3/04

USPC ..... 383/119, 2, 3, 120; 493/70, 79, 80

See application file for complete search history.

(56) References Cited

U.S. PATENT DOCUMENTS

| | | | | | |
|---|---|---|---|---|---|
| 4,158,376 | A * | 6/1979 | Erb | B65D 1/0292 | 220/666 |
| 4,781,472 | A * | 11/1988 | LaFleur | B65D 88/1618 | 383/105 |
| 5,244,682 | A * | 9/1993 | Happ | B65D 81/3461 | 219/732 |
| 6,648,507 | B2 * | 11/2003 | Joshi | B65D 88/1656 | 383/119 |
| 7,552,838 | B2 * | 6/2009 | McDowell | B65D 5/545 | 220/495.01 |

(Continued)

FOREIGN PATENT DOCUMENTS

| | | | | |
|---|---|---|---|---|
| GB | 1510490 A | * | 5/1978 | B65D 25/16 |
| GB | 2194512 A | * | 3/1988 | B65D 77/06 |
| WO | WO 9601772 | * | 7/1994 | B65D 77/06 |

OTHER PUBLICATIONS

Office Action for Chinese Patent Appl. No. 201580021142.9, filed Apr. 16, 2015, 12 pages, dated May 3, 2018.

*Primary Examiner* — Thanh Truong
*Assistant Examiner* — Thomas Wittenschlaeger
(74) *Attorney, Agent, or Firm* — Wood IP LLC

(57) ABSTRACT

A flexible bag and a method for filling a flexible bag which is collapsed when empty, wherein at least one fastening means is provided on a surface of the flexible bag such that at least two upper parts of the flexible bag can be held together by this at least one fastening means during a first part of filling of the flexible bag, whereby the fastening means is designed to release when the bag is filled to a certain amount such that the two upper parts being held together by the fastening means will lose contact.

13 Claims, 7 Drawing Sheets

(56) References Cited

U.S. PATENT DOCUMENTS

| | | | | |
|---|---|---|---|---|
| 7,621,305 | B2 * | 11/2009 | Cho | A45C 7/0063 150/107 |
| 2004/0120612 | A1 * | 6/2004 | La Fleur | B31B 19/36 383/111 |
| 2006/0023973 | A1 * | 2/2006 | Plunkett | B65D 75/5877 383/22 |
| 2006/0120631 | A1 * | 6/2006 | Tang | B65D 33/2508 383/100 |
| 2007/0076988 | A1 * | 4/2007 | Sullivan | B65D 88/1618 383/207 |
| 2007/0086683 | A1 * | 4/2007 | Yeager | B65D 31/10 383/95 |
| 2011/0085750 | A1 * | 4/2011 | Wang | A45C 3/04 383/119 |
| 2012/0312865 | A1 * | 12/2012 | Basconnet | B31B 37/00 229/72 |

* cited by examiner

FLEXIBLE BAG

FIELD OF THE INVENTION

The present invention relates to a flexible bag and a method of filling a flexible bag with fluid.

BACKGROUND OF THE INVENTION

Flexible bags are used for holding liquids of different types, for example in the bioprocessing and food industries. Often they are provided in or coupled with a supporting container.

When filling an empty, collapsed, flexible bag there may be problems with parts of the bag not being filled because of interference by other parts of the bag. This can happen due to friction between bag surfaces and between the bag surface and a supporting container. This can prevent full expansion of the bag.

SUMMARY OF THE INVENTION

One object of the invention is to provide a method for filling a flexible bag with a fluid without the need for manual interaction.

A further object of the invention is to provide a flexible bag that can be completely filled without manual interaction This is achieved by a flexible bag which is collapsed when empty, wherein at least one fastening means is provided on a surface of the flexible bag such that at least two upper parts of the flexible bag can be held together by this at least one fastening means during a first part of filling of the flexible bag, whereby the fastening means is designed to release when the bag is filled to a certain amount such that the two upper parts being held together by the fastening means will lose contact.

This is also achieved by a method for filling a flexible bag which is collapsed when empty, said method comprising the steps of:

connecting two upper parts of the flexible bag by using at least one fastening means provided on a surface of the flexible bag;

filling the flexible bag such that a bottom part of the bag is filled first and then, when a certain amount of the bottom part has been filled the connection between the two upper parts is automatically released and the upper parts are filled.

Hereby the bottom part of the bag will be filled first and then when the fastening means has been released the upper parts of the bag will be filled. The releasing of the fastening means is automatic and therefore no manual interaction is needed during filling. When the bottom parts are filled first there is no risk for interference from the upper parts which could prevent the filling of the bottom parts. Hereby the bag will be completely filled.

In one embodiment of the invention at least one pair of mating fastening means is provided on a surface of the flexible bag such that at least two upper parts of the flexible bag can be held together by this at least one pair of mating fastening means.

In one embodiment of the invention the flexible bag is a cuboid.

In one embodiment of the invention said flexible bag is composed of four sheets sealed together on two opposite sides of the cuboid and in empty stage the flexible bag is folded together showing two top wings and two bottom wings whereby the two top wings are fastened to each other with the fastening means before filling of the flexible bag.

In one embodiment of the invention the fastening means are hook and loop fasteners, tape, adhesives or male/female coupling devices.

In one embodiment of the invention the method further comprises the step of providing the flexible bag inside a supporting container before the filling is started.

DETAILED DESCRIPTION OF EMBODIMENTS OF THE INVENTION

The present invention relates to a flexible bag which is collapsed when empty. At least one fastening means is provided on a surface of the flexible bag such that at least two upper parts of the flexible bag can be held together by this at least one fastening means during a first part of filling of the flexible bag. The fastening means is designed to release when the bag is filled to a certain amount such that the two upper parts being held together by the fastening means will lose contact.

Figure 1A:
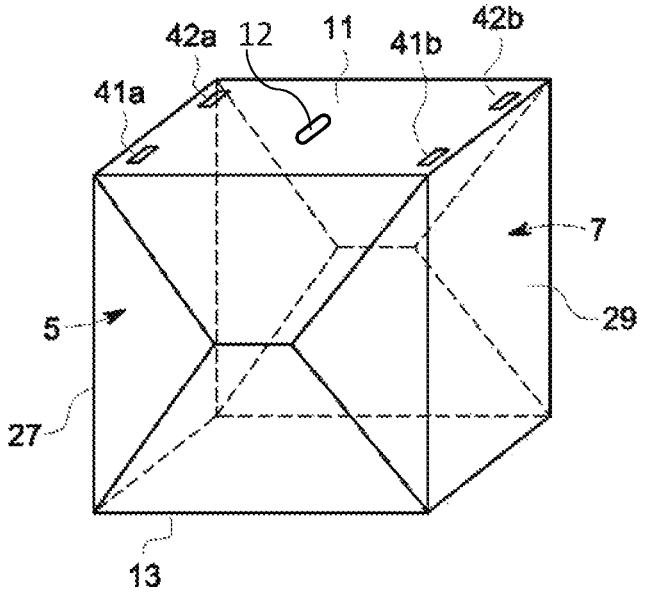
FIG. 1*a* is a schematic drawing of a flexible bag according to one embodiment of the invention.
Figure 1B:
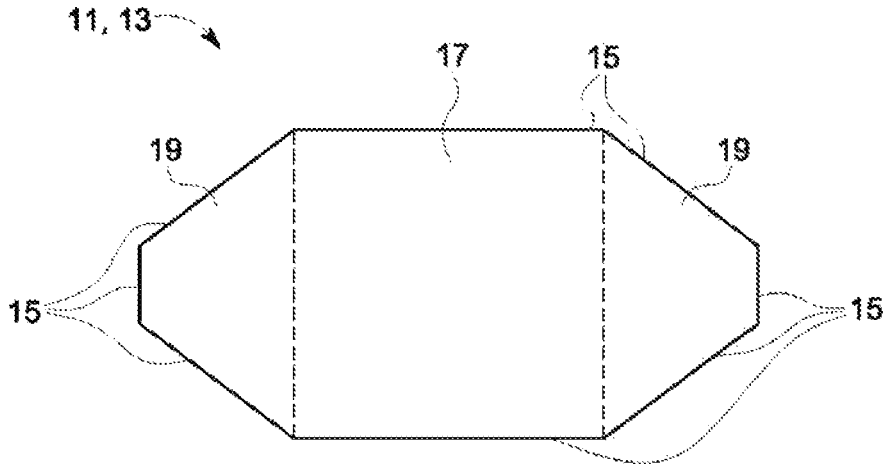
FIG. 1*b* is a schematic drawing of a top or bottom sheet of the flexible bag shown in FIG. 1*a*.
Figure 1C:
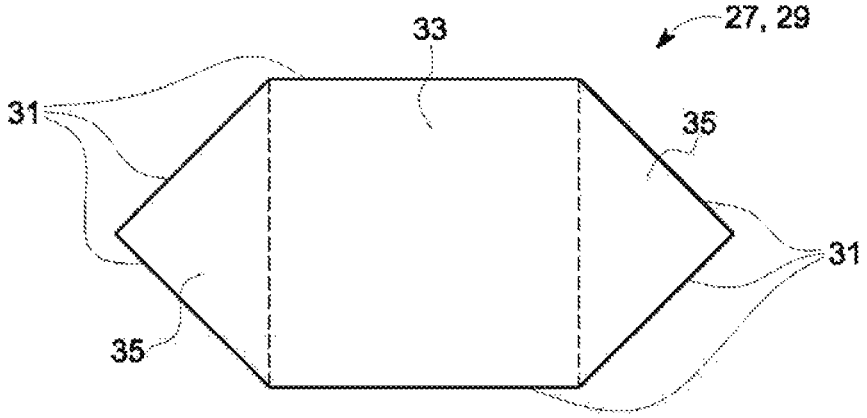
FIG. 1*c* is a schematic drawing of a side sheet of the flexible bag shown in FIG. 1*a*.

FIG. 1*a* is a schematic drawing of a flexible bag according to one embodiment of the invention. This bag is shown to be close to a cube but all the sides do not need to be of the same size. Therefore this example bag is called a cuboid. In this embodiment of the invention the flexible bag is made up from four sheets that are sealed together on two opposite sealing sides 5,7 of the cuboid. A top sheet 11 and a bottom sheet 13 have the same dimensions and have each eight sealing edges 15. The bag also contains an opening 12. These openings are well-known in the art and are used to fill bags of this type from a number of different positions on the bag, including, but not limited to, from the top of the bag. The shape of the top and bottom sheets before sealing into the cuboid is shown in FIG. 1*b*. The top and bottom sheets have the shape of a middle part 17 being a rectangle and two opposing identical side parts 19 being each a trapezoid. This middle part 17 and the two side parts 19 are provided together as one continuous piece of film making up the top and bottom sheets 11, 13. Two side sheets 27, 29 (shown in FIG. 1*c*) also have the same dimensions but not the same as the top and bottom sheets 11, 13. The side sheets have only six sealing edges 31 each. Before sealing, when lying flat the side sheets 27, 29 have the shape of a middle part 33 being a rectangle and two opposing identical side parts 35 each being a triangle pointing away from the middle part. Hereby the two sealing sides 5,7 are composed of the trapezoidal and triangular side parts (19, 35) of the four different sheets 11, 13, 27, 29.

Fastening means are according to the invention provided on a surface of the flexible bag such that at least two upper parts of the flexible bag can be held together. In this embodiment two pair of mating fastening means 41*a,b*, 42*a,b* are shown on a top surface of the flexible bag. The top surface is here the middle part 17 of the top sheet 11. The fastening means are provided close to the sealing edges. In this example two pairs of mating fastening means, such as hook and loop fasteners or male/female coupling devices, are shown. Of course it is possible to have another number of fastening means provided, such as only one pair of fastening means 41*a,b* in the middle, shown in FIG. 1*f*. Also more than two fastening means are possible if needed. Another alternative would be to only provide fastening means on one side of the top sheet. In such a case the fastening means could be a tape or an adhesive which will mate with an optional surface to which it will be mated. This is shown in the embodiment of FIG. 1*g*. One fastening means 43 is shown here provided to one side of an upper part of the flexible bag but the number can of course be varied.

Figure 1D:
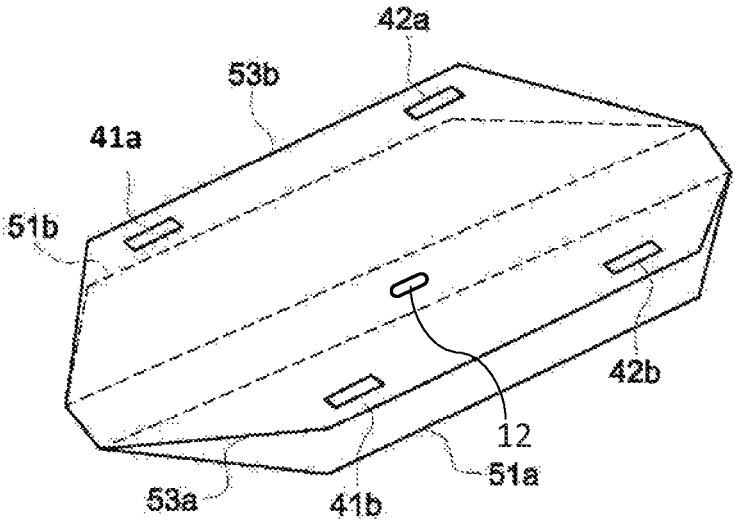
FIG. 1*d* is a schematic drawing of the same flexible bag as in FIG. 1*a* in empty, collapsed position.

FIG. 1*d* is a schematic drawing of the same flexible bag as in FIG. 1*a* in empty and collapsed position. In this collapsed, folded up position two bottom wings 51 *a,b* and two top wings 53 *a,b* are formed. When filling such a bag from the top, for example, via the opening 12, there might be a problem that the two top wings are filled up before the bottom wings resulting in incomplete filling of the bag.

Figure 1E:
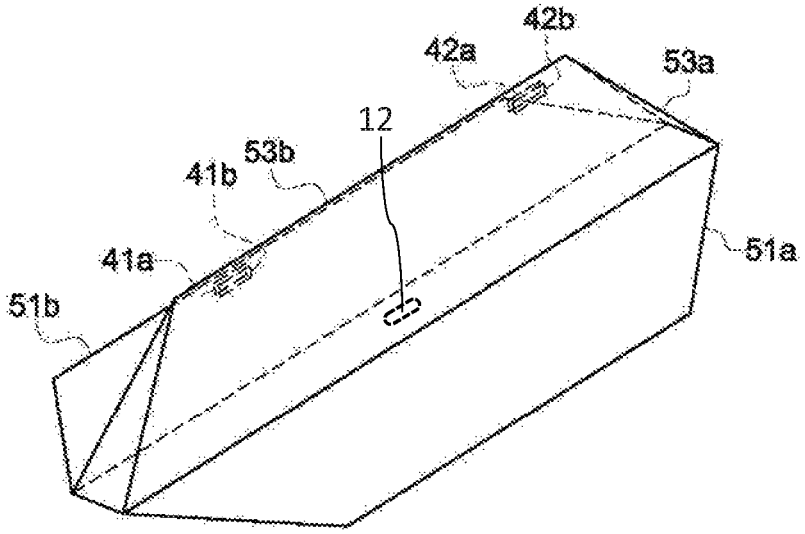
FIG. 1*e* is a schematic drawing of the same flexible bag as in FIG. 1*a* in empty, collapsed position where two upper parts have been fastened to each other by the fastening means.
Figure 1F:
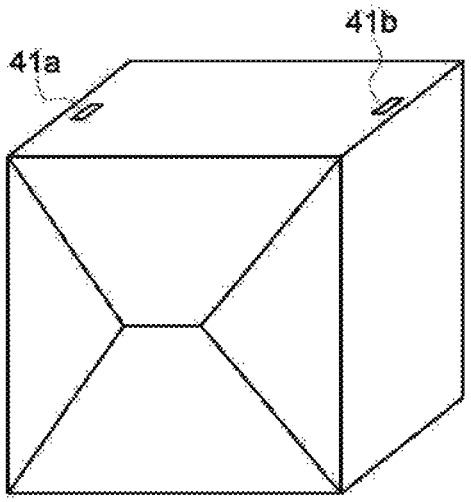
FIG. 1*f* shows another embodiment of the invention where only one pair of mating fastening means is provided on a surface of the bag.
Figure 1G:
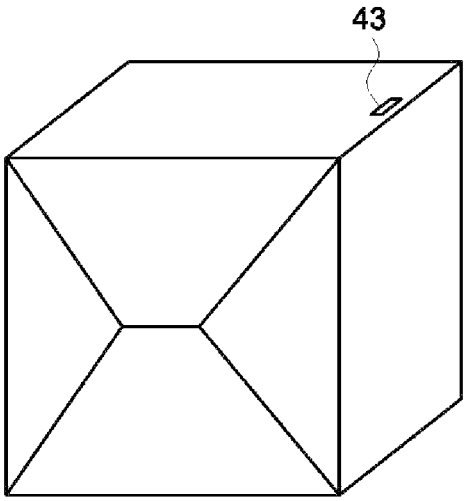
FIG. 1*g* shows another embodiment of the invention where only one piece of fastening means is provided on a surface of the bag.

FIG. 1*e* is a schematic drawing of the same flexible bag as in FIG. 1*a* in empty and collapsed position where two upper parts have been fastened to each other by the fastening means. In this view it can be seen that the fastening means 41*a,b*, 42*a,b* are mated and hold the two top wings (upper parts) 53*a,b* together. Hereby there is no risk that the two top wings will be filled up before the two bottom wings 51*a,b* during filling of the flexible bag.

The fastening means 41*a,b*, 42*a,b* are designed such that they will be released from each other (or if tape or adhesive is used from the attached surface) when the bag has been filled to a certain amount such that the two upper parts being held together by the fastening means will lose contact. The force on the fastening means will increase during filling and the fastening means should be designed to release when the bottom wings 51*a,b* have been filled to a certain amount such that there is no risk for interference from the top wings 53*a,b*.

Figure 2A:
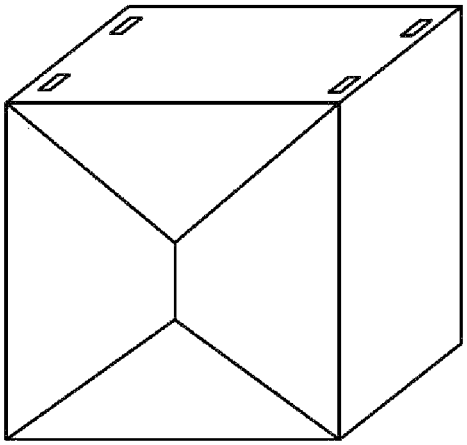
FIG. 2*a* is a schematic drawing of a flexible bag according to another embodiment of the invention.

FIG. 2*a* is a schematic view of another embodiment of a flexible bag according to the invention. The only difference from the embodiment shown in FIGS. 1*a*-1*g* is the orientation, i.e. what is called the top and bottom sheet and what is called the side sheets. The side sheets as defined in FIG. 1*a*-1*g* are here top and bottom sheet and the fastening means are provided on one of them.

Figure 2B:
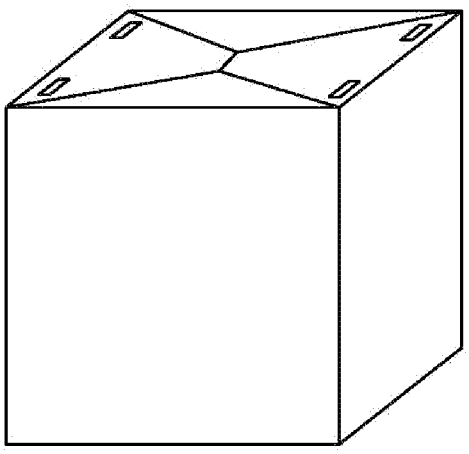
FIG. 2*b* is a schematic drawing of a flexible bag according to another embodiment of the invention.

FIG. 2*b* shows an alternative of FIGS. 1*a*-1*g* where the sealing sides 5,7 according to the definitions in FIG. 1*a*-1*g* are provided as top and bottom side. Hereby the fastening means are provided on a sealing side.

Figure 3:
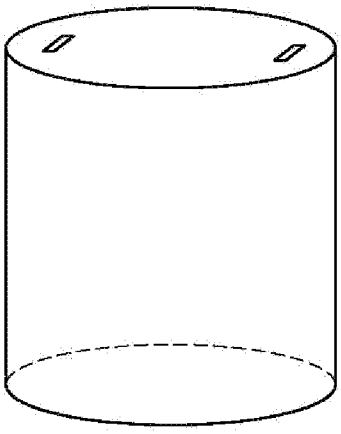
FIG. 3 is a schematic drawing of a flexible bag according to another embodiment of the invention.

FIG. 3 shows another type of flexible bag where the invention could be provided. This is a cylindrical flexible bag. Fastening means are provided on a top surface.

Figure 4:
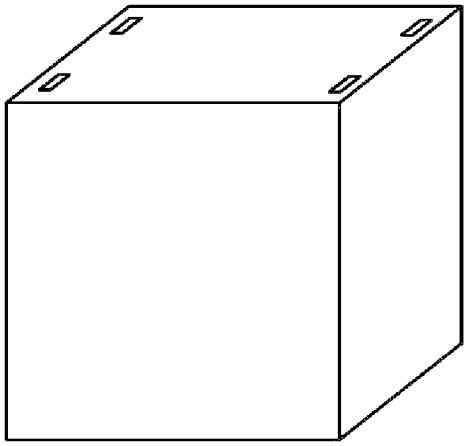
FIG. 4 is a schematic drawing of a flexible bag according to another embodiment of the invention.

FIG. 4 shows another design of a cuboid flexible bag which is composed of six identical sheets instead of four sheets. The fastening means according to the invention could be provided on an upper side of such a flexible bag.

Figure 5:
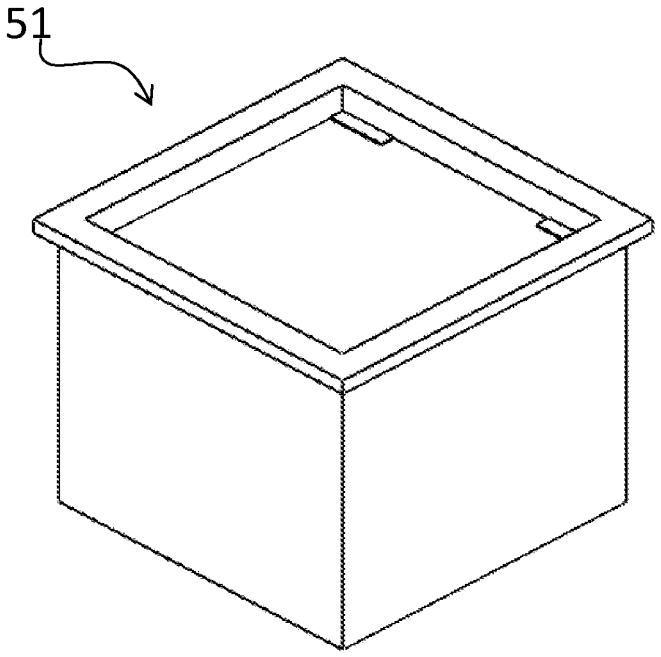
FIG. 5 is a schematic drawing of a supporting container in which any one of the previously shown flexible bags could be provided.

FIG. 5 is a schematic drawing of a supporting container 51 in which any one of the previously shown flexible bags could be provided if a support is needed. The supporting container 51 is more rigid than the flexible bag. Without a supporting container there is a risk that the mass of the fluid inside the flexible bag could tear the bag apart. If a supporting container is used the flexible bag is provided inside the supporting container 51 before the filling is started.

While the particular embodiment of the present invention has been shown and described, it will be apparent to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A flexible bioprocessing bag, comprising:

four sheets forming a cuboid having an upper portion and a lower portion and an opening configured for filling each sheet having a left section, a middle section, and a right section with the middle sections of the four sheets forming the top, the bottom, the left and the right side of the cuboid, the left end sections of the four sheets forming the front side of the cuboid, and the right end sections of the four sheets forming the back side of the cuboid;

at least one fastening means provided on an upper surface of the upper portion; wherein in an empty state, the upper portion forms two upper folds, wherein the fastening means comprises at least one of hook and loop fasteners, tape, adhesives, and male/female coupling devices;

wherein the upper folds are held together and away from the lower portion by the fastening means; and wherein the fastening means is configured to unfasten as the lower portion is being filled to release the upper folds.

2. The flexible bioprocessing bag of claim 1, wherein the fastening means comprises at least one pair of coupling fasteners that are provided on the upper surface such that two upper portions of the flexible bag can be held together by the at least one pair of coupling fasteners.

3. The flexible bioprocessing bag of claim 1, wherein the middle sections of the four sheets are rectangular.

4. The flexible processing bag of claim 1, wherein the middle sections of the four sheets are square.

5. The flexible bioprocessing bag of claim 1, wherein the fastening means comprises hook and loop fasteners.

6. A method of filling a flexible bioprocessing bag that comprises four sheets forming a cuboid having an upper portion and a lower portion and an opening configured for filling, each sheet having a left section, a middle section, and a right section with the middle sections of the four sheets forming the top, the bottom, the left and the right side of the cuboid, the left end sections of the four sheets forming the front side of the cuboid, and the right end sections of the four sheets forming the back side of the cuboid;

at least one fastener provided on an upper surface of the upper portion, wherein the fastener comprises at least one of hook and loop fasteners, tape, adhesives, and male/female coupling devices; wherein in an empty state, the upper portion forms two upper folds, the method comprising the steps of:

a) fastening two upper folds together using the at least one fastener; wherein the fastening is characterized by holding the bag upper folds together and away from the lower portion of the bag in the empty state; and b) filling the bag through the opening such that as the lower portion of the bag fills, the held together fastener unfastens to release the bag upper folds to fill up the upper portion.

7. The method of claim 6, further comprising a step of providing the flexible bioprocessing bag inside of a supporting container before filling the bag through the opening.

8. The method of claim 6, wherein the fastener comprises at least one pair of coupling fasteners that are provided on the upper surface such that two upper portions of the flexible bag can be held together by the at least one pair of coupling fasteners.

9. The method of claim 6, wherein two pair of coupling fasteners are provided on the upper surface such that two upper portions of the flexible bag can be held together by the two pair of coupling fasteners.

10. The method of claim 6, wherein the fastener comprises hook and loop fasteners.

11. A flexible bioprocessing bag, comprising:

four sheets forming a cuboid, wherein each sheet has a left section, a middle section, and a right section with the middle sections of the four sheets forming the top, the bottom, the left and the right side of the cuboid, the left end sections of the four sheets forming the front side of the cuboid, and the right end sections of the four sheets forming the back side of the cuboid and wherein the cuboid has an upper portion and a lower portion and an opening configured for filling;

two pairs of coupling fasteners provided on the top side of the upper portion; wherein in an empty state, the bag is folded together with the upper portion forming two upper folds;

wherein the upper folds are held together and away from the lower portion by the fasteners;

wherein the fasteners are configured to unfasten as the lower portion is being filled to release the upper folds, and wherein the fasteners comprise at least one of hook and loop fasteners, tape, adhesives, and male/female coupling devices.

12. The flexible processing bag of claim 11, wherein the middle sections of the four sheets are square or rectangular.

13. A method of forming the flexible bioprocessing bag of claim 11, the method comprising the steps of:

a) fastening two upper folds together using the two pairs of coupling fasteners;

b) providing the flexible bioprocessing bag inside of a supporting container before filling the bag through the opening, and c) filling the bag through the opening such that as the lower portion of the bag fills, the held together fasteners unfasten to release the bag upper folds to fill up the upper portion.

* * * * *